United States Patent [19]

Pringle

[11] Patent Number: 4,569,398

[45] Date of Patent: Feb. 11, 1986

[54] SUBSURFACE WELL SAFETY VALVE

[75] Inventor: Ronald E. Pringle, Houston, Tex.

[73] Assignee: Camco, Incorporated, Houston, Tex.

[21] Appl. No.: 711,706

[22] Filed: Mar. 13, 1985

Related U.S. Application Data

[63] Continuation-in-part of Ser. No. 538,000, Sep. 30, 1983, Pat. No. 4,527,630.

[51] Int. Cl.[4] ..... E21B 34/10

[52] U.S. Cl. ..... 166/321; 166/323; 166/324; 166/325; 166/332; 251/62; 251/63.4

[58] Field of Search ..... 166/321, 319, 323, 324, 166/325, 332, 72; 251/62, 63, 63.5, 368, 63.4

[56] References Cited

U.S. PATENT DOCUMENTS

| | | | |
|---|---|---|---|
| 3,786,867 | 1/1974 | Tausch et al. | 166/321 |
| 3,799,258 | 3/1974 | Tausch | 166/72 |
| 4,049,052 | 9/1977 | Arendt | 166/183 |
| 4,119,146 | 10/1978 | Taylor | 166/72 |
| 4,173,256 | 11/1979 | Kilgore | 166/324 |
| 4,373,587 | 2/1983 | Pringle | 166/324 |
| 4,452,310 | 6/1984 | Pringle et al. | 166/319 |
| 4,467,870 | 8/1984 | Langham | 166/321 |
| 4,495,998 | 1/1985 | Pringle | 166/321 |
| 4,527,630 | 7/1985 | Pringle | 166/321 |
| 4,527,631 | 7/1985 | Vazquez | 166/324 |

*Primary Examiner*—James A. Leppink
*Assistant Examiner*—Hoang C. Dang
*Attorney, Agent, or Firm*—Fulbright & Jaworski

[57] ABSTRACT

A safety valve having a flow tube telescopically movable in the housing for controlling the opening and closing of the valve in which the housing has a fluid chamber with a piston connected to the flow tube and a fluid passageway connected to the chamber adapted to be in communication with the fluid pressure at the well surface. A valve element and valve seat in the passageway seals off fluid flow through the seat and holds the flow tube in the open position when pressure is applied to the fluid passageway. Spaced minimum leak seals may be provided to form the fluid chamber. An antiburst communication line may be provided between the chamber and the bore of the safety valve having a check valve for equalizing pressure in the chamber. A valve mechanism operable by the flow tube shuts off the flow of fluid in the passageway to the fluid chamber when the valve closure member is in the open position.

19 Claims, 6 Drawing Figures

SUBSURFACE WELL SAFETY VALVE

CROSS REFERENCES TO RELATED APPLICATIONS

This application is a continuation-in-part of U.S. patent application Ser. No. 06/538,000, filed Sept. 30, 1983, now U.S. Pat. No. 4,527,630 entitled Hydraulic Actuating Means for Subsurface Safety Valve.

BACKGROUND OF THE INVENTION

It is becoming increasingly desirable to provide a subsurface well safety valve for controlling the fluid flow through a well conduit in which the safety valve is operated from the surface by fluid pressure in which the valve does not contain elastomer seals, in which the valve can withstand pressures such as up to 30,000 psi working pressure, in which the valve can withstand high temperatures, and in which the valve can be operated at great depths. However, all of this is required to be accomplished with an outside diameter that is dictated by the size of the well casing and an inside diameter equivalent to the well tubing string.

One type of safety valve which is useful is the rod piston type safety valve disclosed in my above-mentioned copending patent application. One feature of the present invention is the provision of an improved rod type piston safety valve.

Another type safety valve is the concentric hydraulic chamber type valve such as shown in U.S. Pat. No. 3,799,258, which provides two seals of different diameters to form a hydraulic chamber. These types of safety valves have limitations for several reasons. First, the seals are positive pressure containing seals, such as elastomers or plastics, which must be placed about a wall of a tube thick enough to withstand 1.5 times the rated working pressure of the safety valve. This chamber must be housed by a threaded joint for assembly that must also withstand these pressures and therefore any such valve results in a larger than desired O.D. or smaller I.D. Secondly, any such positive pressure seal used under high differential pressures create tremendous amounts of friction on the hydraulic operating mechanism of the safety valve which must be overcome by the valve closing forces. This result in reducing the closing force thereby limiting the depth at which the valve can be utilized. Thirdly, it is useless to attempt to combat high temperatures, such as steam injections at 800° F., using elastomer or plastic seals. Fourthly, in concentric designs it is generally difficult to machine a concentric hydraulic cylinder and piston to a small enough area to reduce the hydrostatic head pressure acting on the piston for allowing the safety valve to be set at greater depths. The present invention is also directed to various improvements in a concentric fluid chamber-type safety valve.

SUMMARY

The present invention is directed to a subsurface well safety valve for controlling the fluid flow through a well conduit and includes a housing having a bore and a valve closure member moving between open and closed positions in the bore. A flow tube is telescopically movable in the housing for controlling the movement of the valve closure member and means are provided for biasing the flow tube in a direction for allowing the valve closure member to move to the closed position. One improvement of the present invention is the provision of means for moving the flow tube in a direction for opening the valve closure member which includes spaced seals of different diameters between the housing and the flow tube forming a fluid chamber. A fluid passageway is connected to the fluid chamber and is adapted to be in communication with fluid pressure at the well surface. A piston is provided in the fluid chamber and is connected to the flow tube for moving the flow tube in response to fluid pressure in the chamber. A valve seat and valve element is positioned in the fluid passageway for closing the fluid passageway when the valve closure member is open. Means are provided operable by the flow tube to move the valve element off of the valve seat when pressure is released in the fluid passageway and to hold the flow tube in the open position when pressure is applied to the fluid passageway and to close the passageway.

Another object of the present invention is the provision of spaced seals which are minimum leakage seals which allow fluid flow for pressure equalization in the chamber but provide resistance to the fluid flow for allowing actuation of the piston and the flow tube.

Still a further object of the present invention is wherein the seals are labyrinth seals and may include a plurality of circumferential grooves.

Still a further object of the present invention is wherein the seals are suitable high temperature seals such as ceramic seals which operate in ceramic sleeves and are particularly useful for withstanding high temperature conditions.

Still a further object of the present invention is wherein the cross-sectional area of the valve seat is less than the cross-sectional area of the piston thereby allowing initially higher closing forces but low opening forces.

Yet a still further object of the present invention is the provision of an anti-burst communication line between the chamber and the bore having a check valve which allows fluid flow to the chamber but prevents fluid flow from the chamber thereby reducing the strength required in the safety valve and thereby allowing the valve to meet the geometric space requirements.

A still further object of the present invention is wherein the means operable to move the valve element off of the valve seat includes a rod having a flow path therethrough in which the rod is connected to the flow tube and movable between the chamber and the fluid passageway and through the valve seat.

Still a further object of the present invention is wherein the means operable to move the valve element off the valve seat includes spring means urging the valve element onto the seat and a push rod positioned between the valve element and the flow tube and coacting surfaces on the rod and flow tube for opening and closing the valve seat.

Yet a still further object of the present invention is the provision of a subsurface safety valve having a fluid chamber, a fluid passageway connected to the chamber and adapted to be in communication with fluid pressure at the well surface. A piston is provided in the fluid chamber contacting the flow tube for moving the flow tube in response to fluid pressure in the chamber and a valve seat is provided between the passageway and the chamber. A ball is positioned in the passageway above the seat whereby when pressure is supplied to the passageway, the piston moves the flow tube to the open position and the seated ball holds the piston and flow tube in the open position and shuts off fluid flow to the chamber. When pressure is released, the piston moves through the valve seat by biasing means to unseat the ball. A second valve seat is positioned in the chamber and coacts with the valve element connected to the piston.

Still a further object of the present invention is the provision of a subsurface safety valve having spaced seals of different diameters between the housing and the flow tube forming a fluid chamber with a fluid passageway connected to the chamber and adapted to be in communication with fluid pressure at the well surface. A piston in the fluid chamber is connected to the flow tube for moving the flow tube in response to fluid pressure in the chamber. The seals are minimum leakage seals which allow fluid flow into and out of the chamber for pressure equilization but provide resistance to fluid flow for allowing actuation of the flow tube. Valve means operable by the flow tube are provided for shutting off flow of fluid in the passageway to the fluid chamber when the valve closure means is in the open position. The valve means may be a valve seat and valve element positioned in the fluid passage or first and second valve means between the flow tube and the housing blocking off flow through the spaced seals.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENT

While the present subsurface safety valve will be shown for purpose of illustration only, as incorporated in a flapper type tubing retrievable safety valve, it will be understood that the present invention may be used with other types of safety valves and safety valves having various types of valve closure members.

Figure 1A:
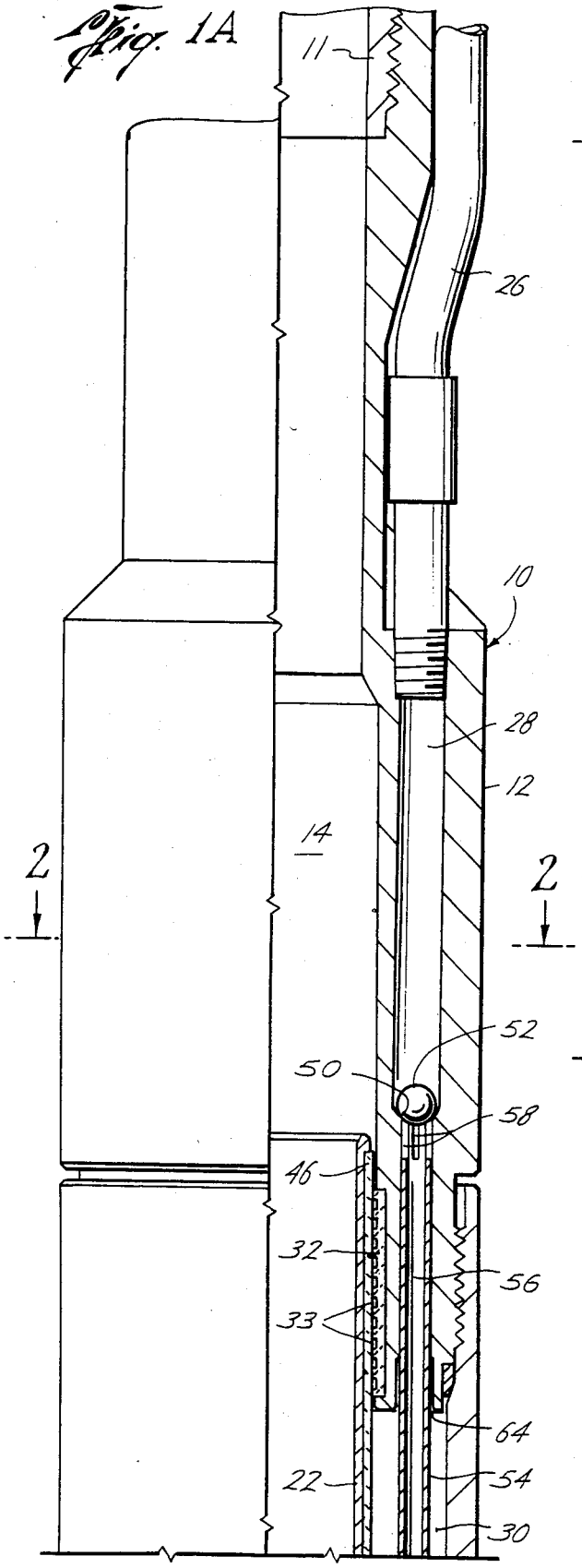
FIG. 1A, 1B and 1C are continuations of each other and are elevational views, in quarter section of a subsurface well safety valve of the present invention shown in the open position.
Figure 1B:
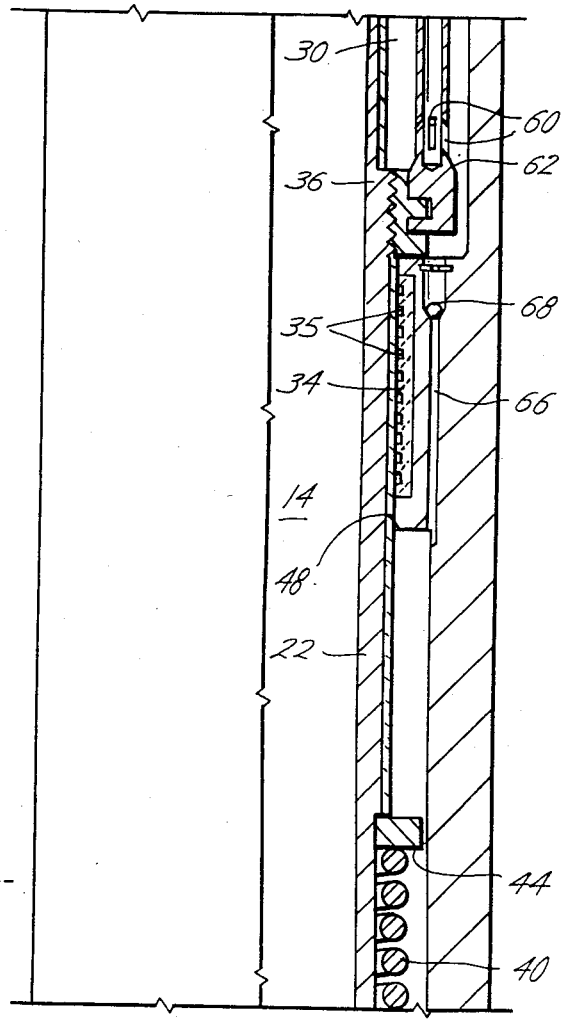
Figure 2:
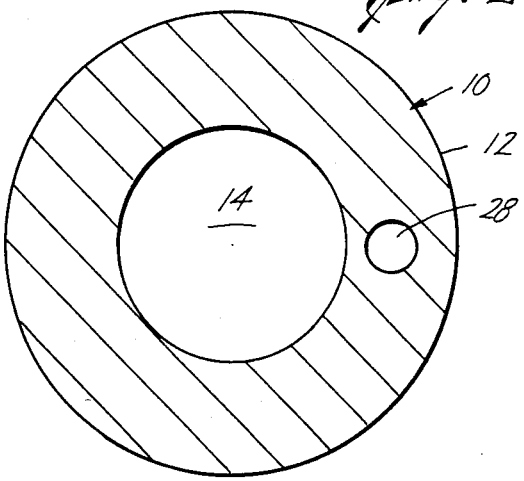
FIG. 2 is a cross-sectional view taken along the line 2—2 of FIG. 1A.
Figure 1C:
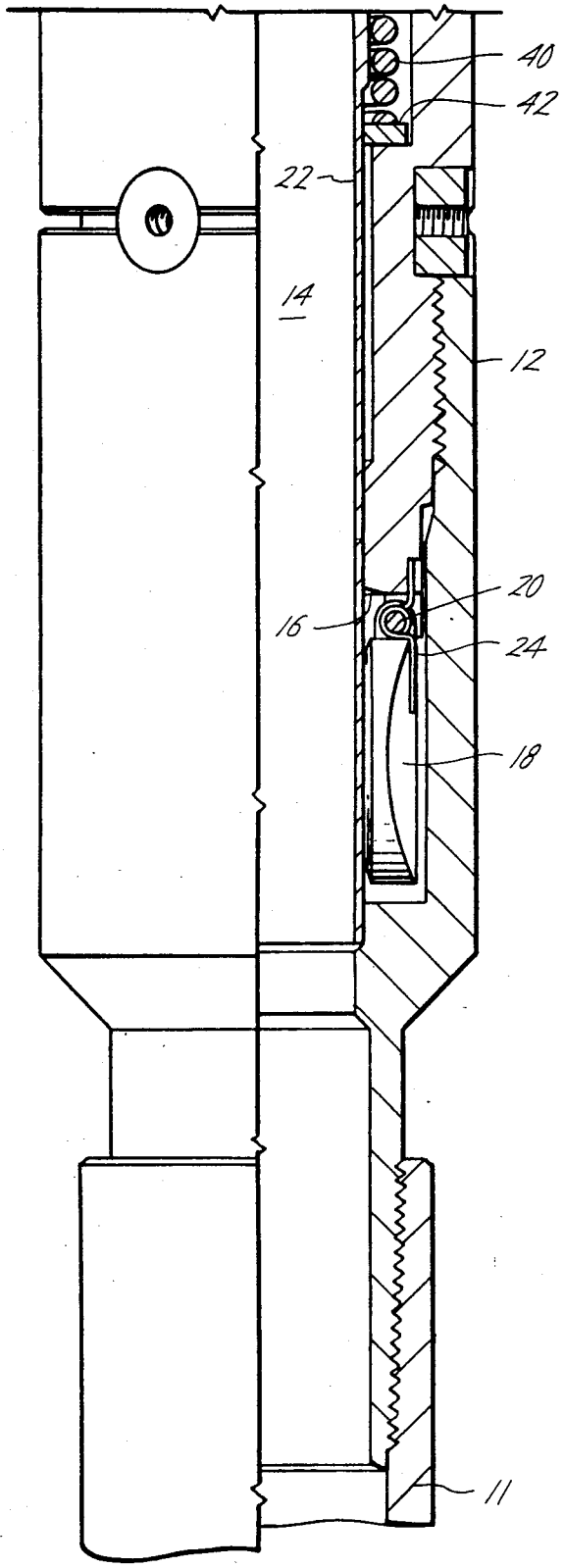

Referring now to the drawings, particularly to FIG. 1A, 1B and 1C, the subsurface safety valve of the present invention is generally indicated by the reference numeral 10 is shown as being a non-retrievable type for connection in a well conduit or well tubing 11 such as by threads. The safety valve 10 generally includes a body or housing 12 adapted to be connected in a well tubing to form a part thereof and to permit well production therethrough under normal operating conditions, but in which the safety valve 10 may close or be closed as desired.

The safety valve 10 includes a bore 14, a valve closure member or flapper valve 18 connected to the body 12 by a pivot pin 20. Thus, when the flapper 18 is in the upward position and seated on the valve seat 18, the safety valve 10 is closed blocking flow upwardly through the bore 14 and the well tubing 11. A tubular member or flow tube 22 is telescopically movable in the body 12 and through the valve seat 16.

As best seen in FIG. 1C, when the flow tube 22 is moved to a downward position, the tube 22 pushes the flapper 18 away from the valve seat 16. Thus the valve 10 is held in the open position so long as the flow tube 22 is in the downward position. When the flow tube 22 is moved upwardly, the flapper 18 is allowed to move upwardly onto the seat 16 by the action of a spring 24.

The safety valve 10 is controlled by the application or removal of a pressurized fluid through a control path or line such as conduit 26 extending to the well surface which supplies a pressurized fluid to a fluid passageway 28 and to a fluid chamber 30 which is formed by spaced seals 32 and 34 of different diameters. A piston 36 is movable in the fluid chamber 30 and is connected to the flow tube 22. When pressure is applied through the conduit 26, the piston 36 and flow tube 22 will be moved downwardly forcing the valve closure member 18 off of the seat 16 and into the full open position. If the fluid pressure in the conduit 26 is reduced sufficiently, various biasing means will urge the tube 22 upwardly beyond the seat 16 allowing the flapper 18 to swing and close the seat 16. The biasing means may include a spring 40 acting between a shoulder 42 on the housing 12 and a shoulder 44 on the flow tube 22. The biasing means may also include pressurized fluid such as the pressure of the fluid in the bore 14 acting on the bottom of the piston 36.

As shown in U.S. Pat. No. 3,799,258, it is well known to utilize a safety valve having a concentric hydraulic chamber formed by spaced seals of different diameters. However, in the prior art the seals have been O-ring elastomer seals which are positive pressure containing seals for preventing pressure leakage from the hydraulic chamber. Such seals must be placed upon the wall of a flow tube thick enough and rated to withstand 1.5 times the working pressure of the safety valve and the chamber was required to be housed by a threaded joint that could withstand these pressures. Consequently the safety valve resulted in a larger than desired O.D. or smaller I.D. Furthermore, the positive pressure O-rings introduced a tremendous amount of drag friction on the flow tube thereby reducing the closing forces available by the biasing means such as springs. Furthermore, such elastomer or plastic-type O-rings could not withstand high temperatures such as 800° F.

In the present invention, the seals 32 and 34 may be of any suitable type of minimum leaking seal that offers resistance to fluid flow so that the piston 36 may be actuated from the well surface but provide a slight radial or axial clearance to equalize the pressure in the chamber 30 thereby reducing the structural strength required in the housing 12 and flow tube 22. That is, the wall thickness at the seal points is only significant in being designed to hold enough pressure differential to open the safety valve. Preferably the seals 32 and 34 are labyrinth type seals having a plurality of circumferential grooves 33 and 35, respectively, which provide for successive expansion of the fluid by creating multi-pressure drops in sequence.

Preferably, for use in extremely high temperature environments, the seals 32 and 34 are made of suitable high temperature seals such as ceramic material, for example 96% $Al_2O_3$ sold by Coors Ceramics as Type K-6 and in that event suitable liner sleeves 46 and 48 are provided on the flow tube 26 for the seals 32 and 34, respectively. The liner sleeves 46 and 48 are also of a ceramic material.

However, since the seals 32 and 34 are designed to provide leakage into and from the chamber 30, it is desirable to provide means for limiting the amount of leakage from the chamber 30 of the hydraulic control fluid supplied through the line 26. Therefore, a valve seat 50 and a valve element such as ball 52 are provided in the fluid passageway 28 above the chamber 30. In addition, suitable means are provided operable by the flow tube 22 to move the valve element 52 off of the valve seat when pressure is released in the fluid passageway 28 but to hold the flow tube 22 in the open position when the pressure is applied to the fluid passageway 28. Such means, as best seen in FIGS. 1A and 1B, include a rod 54 having a flow path therethrough, either internally or externally, such as a bore 56 and openings 58 and 60. The rod 54 is connected to the piston 36. When pressure is applied to the fluid passageway 28, the control fluid will flow through the openings 58, bore 56 and openings 60 into the fluid chamber 30 acting on the piston 36 to move the flow tube 22 to a downward and open position causing the valve element 52 to seat on the valve seat 50 and to act against the rod 54 to hold the valve 10 in the open position so long as pressure is applied to the fluid passageway 28. When pressure is reduced in the fluid passageway 28, the biasing forces including the spring 40 move the flow tube 22 upwardly and move the rod 54 through the valve seat 50 carrying the ball 52 upwardly. With the valve in the closed position, a second valve element 62 on the rod 54 moves upwardly to seat on a second valve seat 64 at the bottom of the fluid passageway 28. When the valve moves to the closed position, the flow tube 22 would be subject to its maximum burst pressure between the two seals 32 and 34 (that is the low pressure of the hydrostatic head in the control line 26 and the high pressure of the tubing pressure in the bore 14). However, this possible maximum burst pressure is prevented by the controlled leakage of tubing pressure fluid from the bore 14 through the seals 32 and 34 into the fluid chamber 30.

If desired, an anti-burst communication line 66 is provided in the housing between the fluid chamber 30 and the pressure in the bore 14 (by flowing around the lower end of the flow tube 22). The line 66 includes a check valve 68 which allows fluid flow to the chamber 30 but prevents fluid flow from the chamber 30 thereby providing another means for allowing equalization of the pressures in the fluid chamber 30 upon closure of the valve 10, but allows the fluid chamber to be pressurized from the control line 26 for opening the valve 10. It is to be noted that this feature of the anti-burst communication line and check valve may be utilized in other types of concentric hydraulic chamber type safety valves including those utilizing positive seals such as O-ring seals and still allow the flow tube 22 to be constructed of a thin wall that is not required to withstand the entire tubing pressure in the bore 14 and thus would not be required to be rated the standard 1.5 times the working pressure of the safety valve.

Another desirable features of safety valves is the feature that allows the safety valve to be set at great depths. However, when safety valves are set at great depths, the valve closing forces need to be higher than the hydrostatic head forces created by the hydrostatic fluid in the control line or path 26 which extends to the depths at which the valve is set. In concentric chamber type valves of the prior art, it was generally difficult to machine the two different diameters to dimensions necessary for the hydraulic chamber areas to be small enough to reduce the hydrostatic head pressures acting upon the actuating piston. Furthermore, with concentric designs with the small area and elastomeric seals, a high pressure friction acted on the flow tube to reduce the closing forces available from the biasing means such as the spring 40. The labyrinth design seals 32 and 34 create little friction against the flow tube 22 thereby allowing maximum utilization of the biasing forces including the biasing force of the spring 40 for closing the valve 10. Furthermore, the area of the valve seat 50 may be made small as compared with the area of the piston 36 between the two different diameter seals 32 and 34. This reduces the amount of hydrostatic head on the piston 36 to the hydrostatic forces acting upon the area of the ball 52 for providing an initial high closing force (by reducing the hydrostatic head force) but providing a low opening force since the pressure in the fluid control line 26 operates on a relatively large piston area 36.

Figure 3:
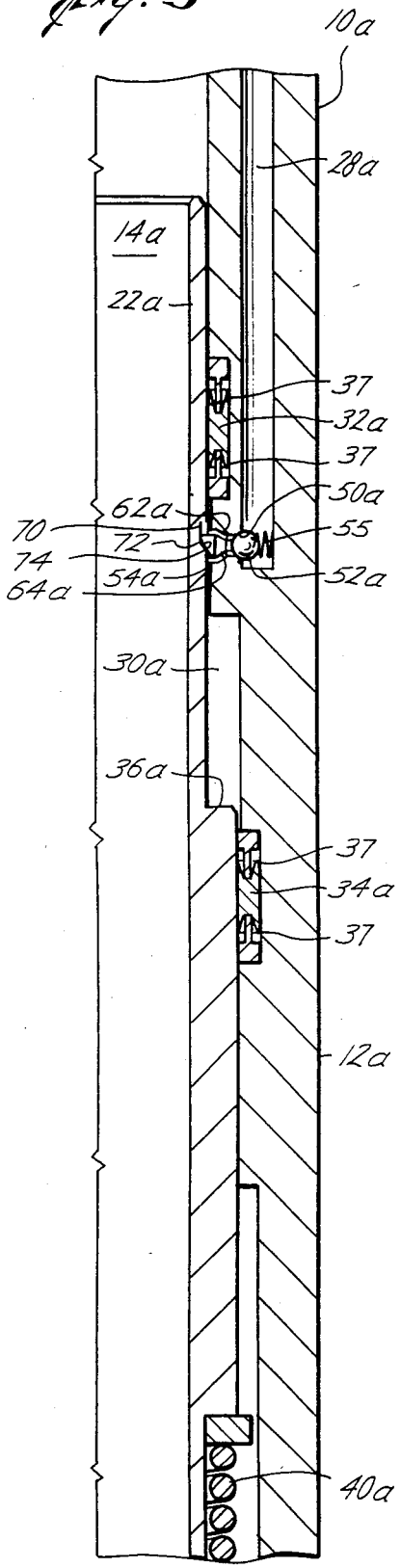
FIG. 3 is a fragmentary cross-sectional view of another embodiment of the present invention.

Referring now to FIG. 3, a further embodiment of the present invention is best seen wherein like parts to the other views are similarly numbered with the addition of the suffix "a". In this embodiment, the seals **32*a* and 34*a* instead of being ceramic seals are metal cup seals having outwardly extending lips 37 at each end as more fully described in my copending patent application mentioned above. The metal seals are particularly advantageous for higher pressure applications than the ceramic seals 32 and 34 but are still minimum leakage seals to provide the advantages previously discussed in connection with the other embodiments. In the embodiment of FIG. 3, the seat 50*a* and valve element 52*a* are provided in the passageway 28*a*. The ball 52*a* is urged toward the seat 50*a* by a spring 55. A push rod 54*a* acts between the exterior of the flow tube 22*a* and the ball 50*a* for moving the ball off of the seat when the flow tube 22*a* moves upwardly toward its closed position and valve element 62*a* on rod 54*a*. However, when the flow tube 22*a* moves to the open position as shown, the push rod 54*a* moves into a recess 70 in the exterior of the flow tube 22*a*. Coacting surfaces 72 and 74 on the push rod 54*a* and on the flow tube 22*a*, respectively, allow the ball 50*a*, when the valve is in the open position, and the push rod 54*a* to hold the flow tube 22*a* in the open position. However, when pressure is released in the fluid passageway 28*a*, the flow tube 22*a* will move upwardly to move the ball 50*a* off of the seat 52*a***.

Figure 4:
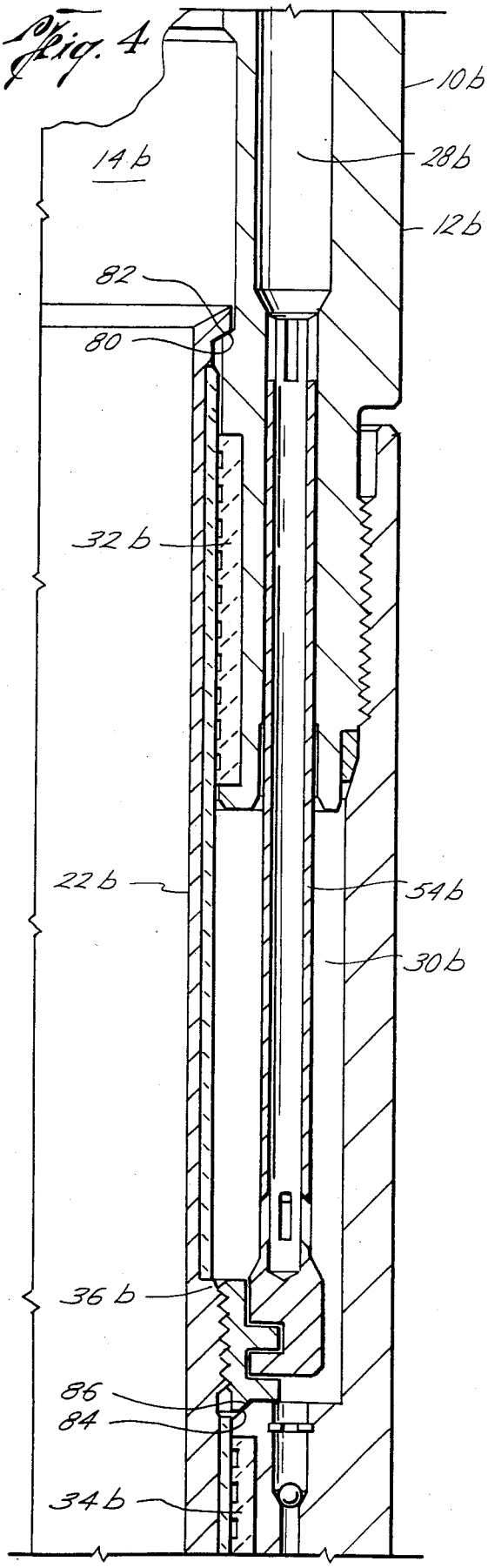
FIG. 4 is a fragmentary cross-sectional view of another embodiment of the present invention.

Referring now to FIG. 4, another embodiment of the present invention is shown wherein like parts corresponding to those of FIGS. 1A–1C are similarly numbered with the addition of the suffix "b".

In using the minimum leakage seals **32*b* and 34*b*, suitable valve means must be provided for shutting off the flow of fluid from the passageway 28*b* to the fluid chamber 30*b* when the valve 10 is in the open position. This was accomplished in the embodiment of FIG. 1A–1C by the ball 50 and seat 52. In the embodiment shown in FIG. 4, first and second valve means are provided between the flow tube 22*b* and the housing 12*b* to block off flow through the spaced seals 32*b* and 34*b* when the valve 10 is in the open position. Thus, a first valve means consisting of coacting shoulders 80 and 82 on the flow tube 22*b* and housing 12*b*, respectively, are provided and a second valve means comprising shoulders 84 and 86 on the flow tube 22*b* and housing 12*b*, respectively, are provided. When the valve 10 moves to the open position, as shown in FIG. 4, the shoulders 80 and 84 seat against the shoulders 82 and 86, respectively, to block off fluid flow between the chamber 30***b* and the bore 14*b* thereby preventing the flow of fluid from the passageway 28*b* into the chamber 30*b*.

Figure 5:
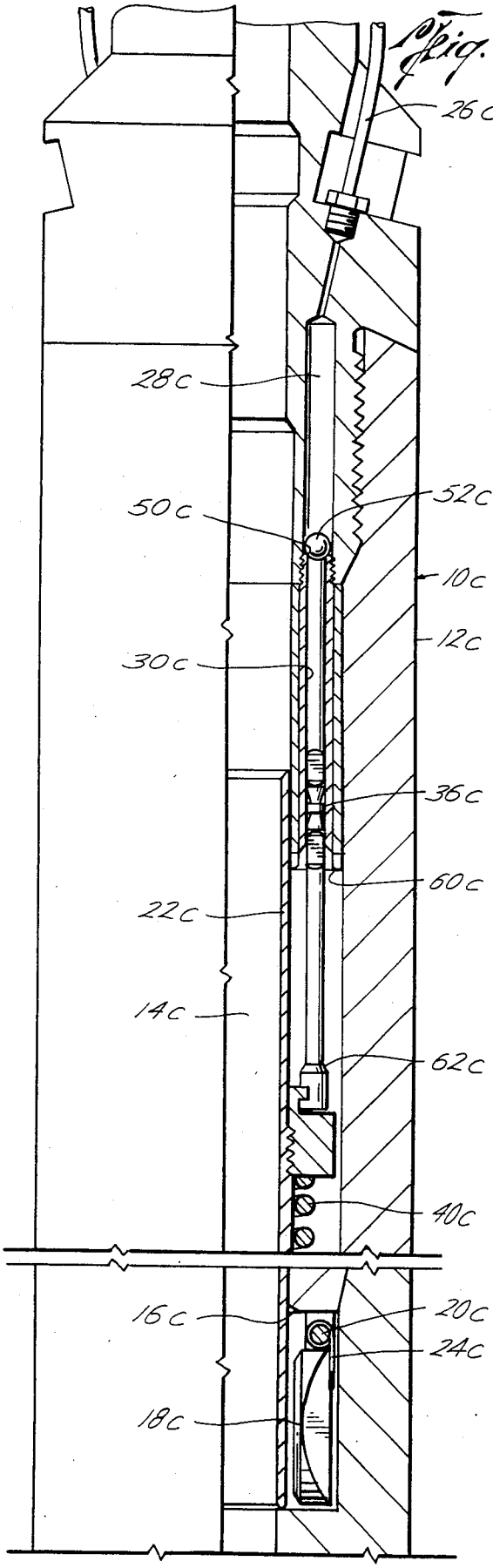
FIG. 5 is a fragmentary cross-sectional view of the present invention.

Referring now to FIG. 5, a further embodiment is shown wherein like parts to FIGS. 1A–1C are similarly numbered with the addition of the suffix "c". In this embodiment, the seals 32 and 34 are omitted thereby equilizing fluid pressure by allowing the tubing pressure to flow around the flow tube 22*c* into the bottom of the fluid chamber 30*c* thereby allowing flow tube 22*c* to be of a minimum structural size. A piston 36*c* is movable in the cylinder 30*c* in response to fluid pressure applied through the line 26*c* to the fluid passageway 28*c*. The piston 36*c* may be of the type illustrated in my copending patent application above mentioned such as a metal cup seal. Application of fluid pressure to the top of the piston 36*c* moves the piston 36*c* and the flow tube 22*c* downwardly to open the valve closure member 18*c*. When the valve 10 is moved to the open position, the ball 52*c* seats on the valve seat 50*c* to prevent passage of control fluid from the passageway 28*c* into the bore 14*c* while at the same time holding the flow tube 22*c* in the open position. Upon release of the pressure in the fluid passageway 28*c*, the biasing forces including the spring 40*c* and tubing pressure in the bore 14*c* move the piston 36*c* upwardly to unseat the ball 52*c*.

The present invention, therefore, is well adapted to carry out the objects and attain the ends and advantages mentioned as well as others inherent therein. While presently preferred embodiments of the invention have been given for the purpose of disclosure, numerous changes in the detail of construction and arrangement of parts will be readily apparent to those skilled in the art and which are encompassed within the spirit of the invention and the scope of the appended claims.

What is claimed is:

1. In a subsurface well safety valve for controlling the fluid flow through a well conduit and including a housing having a bore and a valve closure member moving between open and closed positions in the bore, a flow tube telescopically movable in the housing for controlling the movement of the valve closure member, means for biasing the flow tube in a direction for allowing the valve closure member to move to the closed position, the improvement in means for moving the flow tube in a direction for opening the valve closure member comprising, spaced seals of different diameters between the housing and the flow tube forming a fluid chamber, a fluid passageway connected to the fluid chamber and adapted to be in communication with fluid pressure at the well surface, a piston in the fluid chamber connected to the flow tube for moving the flow tube in response to fluid pressure in the chamber, a valve seat and valve element positioned in the fluid passageway for closing the passageway when the valve closure member is opened, and means operable by the flow tube to move the valve element off the valve seat when pressure is released in the fluid passageway and to hold the flow tube in the open position when pressure is applied to the fluid passageway.

2. The apparatus of claim 1 wherein said spaced seals are minimum leakage seals which allow fluid flow for pressure equalization of the fluid chamber but provide resistance to the fluid flow for allowing actuation of the flow tube.

3. The apparatus of claim 2 wherein said seals are labyrinth seals.

4. The apparatus of claim 3 wherein said seals include a plurality of circumferential grooves.

5. The apparatus of claim 3 wherein seals are ceramic seals.

6. The apparatus of claim 1 wherein the cross-sectional area of the valve seat is less than the cross-sectional area of the piston for providing initial high closing forces and low opening forces.

7. The apparatus of claim 1 including, a anti-burst communication line between the chamber and the bore having a check valve which allows fluid flow to the chamber.

8. The apparatus of claim 1 wherein the means operable to move the valve element off the valve seat includes, a rod having a flow path therethrough, said rod connected to the flow tube and movable between the chamber and the fluid passageway and through the valve seat.

9. The apparatus of claim 1 wherein the means operable to move the valve element off the valve seat includes, spring means urging said valve element onto the seat, a push rod positioned between the valve element and the flow tube, and coacting surfaces on the rod and flow tube for opening and closing the valve seat.

10. The apparatus of claim 9 wherein the flow tube includes a recess for receiving said push rod, and said recess and push rod coacting surfaces are wedge shaped surfaces for holding the flow tube in the open position when pressure in the fluid passageway holds the valve element in the seated position and the wedge shaped surfaces in engagement.

11. In a subsurface well safety valve for controlling the fluid flow through a well conduit and including a housing having a bore and a valve closure member moving between open and closed positions in the bore, a flow tube telescopically movable in the housing for controlling the movement of the valve closure member, means for biasing the flow tube in a direction for allowing the valve closure member to move to the closed position, the improvement in means for moving the flow tube in a direction for opening the valve closure member comprising, a fluid chamber in the housing, a fluid passageway connected to the fluid chamber and adapted to be in communication with fluid pressure at the well surface, a piston in the fluid chamber connected to the flow tube for moving the flow tube in response to fluid pressure in the chamber, and an anti-burst communication path between the chamber and the bore having a check valve which allows fluid flow to the chamber but prevents fluid flow from the chamber to the bore.

12. In a subsurface well safety valve for controlling the fluid flow through a well conduit and including a housing having a bore and a valve closure member in the bore moving between open and closed positions, a flow tube telescopically movable in the housing for controlling the movement of the valve closure member, means for biasing the flow tube in a direction for allowing the valve closure member to move to the closed position, the improvement in means for moving the flow tube in a direction for opening the valve closure member comprising, said housing having a fluid chamber, a fluid passageway connected to the fluid chamber and adapted to be in communication with fluid pressure at the well surface, a piston in the fluid chamber contacting the flow tube for moving the flow tube in response to fluid pressure in the chamber, valve seat between the passageway and the chamber, a ball positioned in the passageway above the seat whereby when pressure is supplied to the passageway the piston moves the flow tube to the open position and the ball seats and holds the piston and flow tube in the open position and when pressure is released the piston moves through the valve seat to unseat the ball, and a second valve seat positioned in the chamber and coacting with a second valve element connected to the piston.

13. In a subsurface well safety valve for controlling the fluid flow through a well conduit and including a housing having a bore and a valve closure member moving between open and closed positions in the bore, a flow tube telescopically movable in the housing for controlling the movement of the valve closure member, means for biasing the flow tube in a direction for allowing the valve closure member to move to the closed position, the improvement in means for moving the flow tube in a direction for opening the valve closure member comprising, spaced seals of different diameters between the housing and the flow tube forming a fluid chamber, said seals being ceramic labyrinth seals providing fluid leakage for pressure equalization but providing resistance to fluid flow, ceramic sleeve means coacting with the seals, a fluid passageway connected to the fluid chamber and adapted to be in communication with fluid pressure at the well surface, a piston in the fluid chamber connected to the flow tube for moving the flow tube in response to fluid pressure in the chamber, a valve seat and a valve element positioned in the fluid passageway for closing the passageway when the valve closure member is opened, and means operable by the flow tube to move the valve element off the valve seat when pressure is released in the fluid passageway and to hold the flow tube in the open position when pressure is applied to the fluid passageway.

14. The apparatus of claim 13 wherein the cross-sectional area of the valve seat is less than the cross-sectional area of the piston for providing high closing forces and low opening forces.

15. The apparatus of claim 13 including, an anti-burst communication line between the chamber and the bore having a check valve which allows fluid flow to the chamber but prevents fluid flow from the chamber.

16. The apparatus of claim 13 wherein the means operable to move the valve element off the valve seat includes, a rod having a flow path therethrough, said rod connected to the flow tube and movable between the chamber and the fluid passageway and through the valve seat.

17. In a subsurface well safety valve for controlling the fluid flow through a well conduit and including a housing having a bore and a valve closure member moving between open and closed positions in the bore, a flow tube telescopically movable in the housing for controlling the movement of the valve closure member, means for biasing the flow tube in a direction for allowing the valve closure member to move to the closed position, the improvement in means for moving the flow tube in a direction for opening the valve closure member comprising, spaced seals of different diameters between the housing and the flow tube forming a fluid chamber, a fluid passageway connected to the fluid chamber and adapted to be in communication with fluid pressure at the well surface, a piston in the fluid chamber connected to the flow tube for moving the flow tube in response to fluid pressure in the chamber, said seals being minimum leakage seals which allow fluid flow into and out of said chamber for pressure equilization but provide resistance to fluid flow for allowing actuation of the flow tube, and valve means operable by the flow tube for shutting off flow of fluid from the passageway to the fluid chamber when the valve closure member is in the open position.

18. The apparatus of claim 17 wherein the valve means includes, a valve seat and a valve element positioned in the fluid passageway.

19. The apparatus of claim 17 wherein the valve means includes, first and second valve means between the flow tube and the housing blocking off flow through the spaced seals.

* * * * *